US009540852B2

(12) United States Patent
Thomas et al.

(10) Patent No.: US 9,540,852 B2
(45) Date of Patent: Jan. 10, 2017

(54) DOOR HANDLE SYSTEM FOR AN AUTOMOTIVE VEHICLE

(71) Applicant: Ford Global Technologies, LLC, Dearborn, MI (US)

(72) Inventors: Freeman Thomas, Laguna Beach, CA (US); David Woodhouse, Bromsgrove (GB); Jordan Bennett, Essex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 27 days.

(21) Appl. No.: 14/603,744

(22) Filed: Jan. 23, 2015

(65) Prior Publication Data

US 2015/0137537 A1 May 21, 2015

Related U.S. Application Data

(62) Division of application No. 11/620,217, filed on Jan. 5, 2007, now Pat. No. 8,943,752.

(51) Int. Cl.
*E05B 81/78* (2014.01)
*E05B 85/10* (2014.01)
*E05B 85/00* (2014.01)

(52) U.S. Cl.
CPC ..... *E05B 81/78* (2013.01); *E05B 85/01* (2013.01); *E05B 85/10* (2013.01); *E05B 85/103* (2013.01); *Y10T 292/57* (2015.04)

(58) Field of Classification Search
CPC ..... E05B 85/103; E05B 85/107; E05B 85/01; E05B 85/10; E05B 81/78
See application file for complete search history.

(56) References Cited

U.S. PATENT DOCUMENTS

| | | | | |
|---|---|---|---|---|
| 2,337,531 | A | 12/1943 | Stockton | |
| 2,717,796 | A | 9/1955 | Cudney | |
| 4,778,207 | A | 10/1988 | Gergoe | |
| 5,560,659 | A | 10/1996 | Dault | |
| 6,062,614 | A | 5/2000 | Petzold | |
| 6,838,976 | B2 | 1/2005 | Mindl et al. | |
| 7,102,486 | B2 | 9/2006 | Yamagishi | |
| 7,108,301 | B2 | 9/2006 | Louvel | |
| 7,145,436 | B2 | 12/2006 | Ichikawa et al. | |
| 2004/0177478 | A1* | 9/2004 | Louvel | E05B 81/78 16/430 |
| 2006/0273088 | A1* | 12/2006 | Burkat et al. | 220/212.5 |
| 2013/0170241 | A1* | 7/2013 | Lesueur et al. | 362/501 |

FOREIGN PATENT DOCUMENTS

| | | | | |
|---|---|---|---|---|
| DE | 3818187 C1 | | 8/1989 | |
| DE | WO 2004079137 A2 | * | 9/2004 | E05B 77/02 |
| GB | 576224 A | * | 3/1946 | E05B 85/14 |

* cited by examiner

*Primary Examiner* — Brian Mattei
*Assistant Examiner* — Catherine A Kelly
(74) *Attorney, Agent, or Firm* — Frank A. MacKenzie; Brooks Kushman P.C.

(57) ABSTRACT

A door handle system for an automotive vehicle door includes a door handle and a body panel. The body panel is moveable between a flush position and a recessed position. If the body panel is in the flush position, portions of the door handle are concealed. If the body panel is in the recessed position, portions of the door handle are visible.

7 Claims, 5 Drawing Sheets

DOOR HANDLE SYSTEM FOR AN AUTOMOTIVE VEHICLE

CROSS-REFERENCE TO RELATED APPLICATION

This application is a divisional of application Ser. No. 11/620,217, filed Jan. 5, 2007, the disclosure of which is hereby incorporated in its entirety by reference herein.

BACKGROUND OF THE INVENTION

1. Field of the Invention

The invention relates to door handle systems for automotive vehicles.

2. Discussion

Exterior door handles may permit a user to open a door of a vehicle. If the door is unlatched from the vehicle, the user may pull on the handle to open the door. If the door is unlocked but not unlatched from the vehicle, actuating the door handle may unlatch the door from the vehicle.

Unauthorized entry into a vehicle may include the unauthorized actuation of a door handle to unlatch a door from the vehicle.

SUMMARY

Embodiments of the invention may take the form of a door handle system for a automotive vehicle door. The system includes a door connected to the vehicle. The door includes a latching mechanism for latching the door to the vehicle. The system also includes a door handle connected to the latching mechanism such that actuation of the door handle unlatches the door from the vehicle. The system further includes a door panel. The door panel is moveable between first and second positions.

Embodiments of the invention may take the form of a door handle system for an automotive vehicle door. The system includes a door connected to the vehicle. The door includes a latching mechanism for latching the door to the vehicle. The system also includes a door handle having a finger receiving portion configured to receive a finger of a user. The system further includes a door panel adjacent the door handle. The door panel is moveable between first and second positions and connected to the latching mechanism such that moving the door panel from the first position to the second position unlatches the door from the vehicle.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

Figure 1:
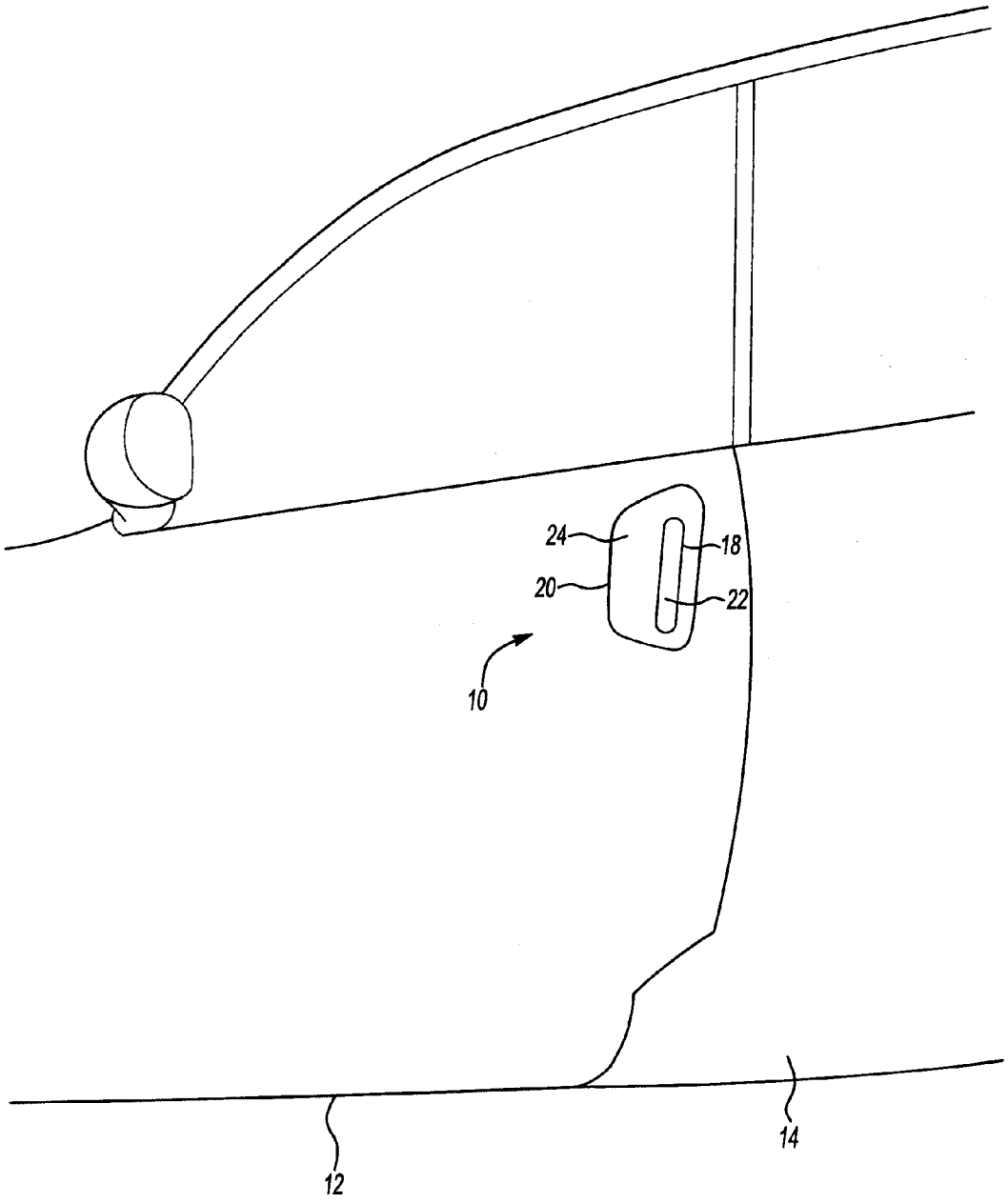
FIG. 1 is a perspective view of a door handle system in accordance with an embodiment of the invention.

FIG. 1 is a perspective view of an embodiment of door handle system 10 for door 12 of vehicle 14. Door 12 is attached with vehicle 14 via hinges (not shown). Door 12 can be opened or closed in any conventional fashion. If door 12 is closed, it can be latched to vehicle 14 via conventional latch 16 (FIG. 4*a*).

Figure 2:
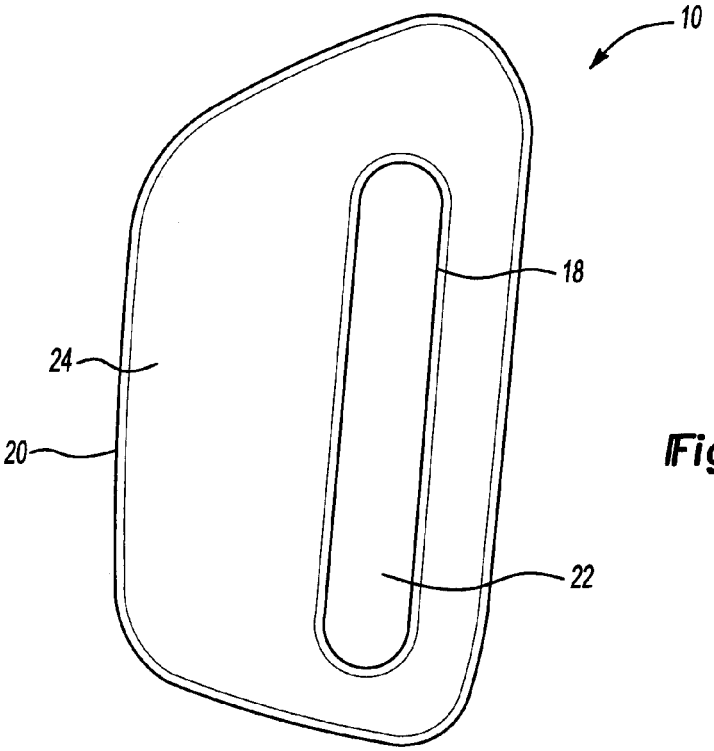
FIG. 2 is an elevation view of the door handle system of FIG. 1 and shows the body panel flush with the door handle.

FIG. 2 is a elevation view of system 10. System 10 includes door handle 18 and body panel 20. As shown, body panel 20 is flush with door handle 18.

Figure 3:
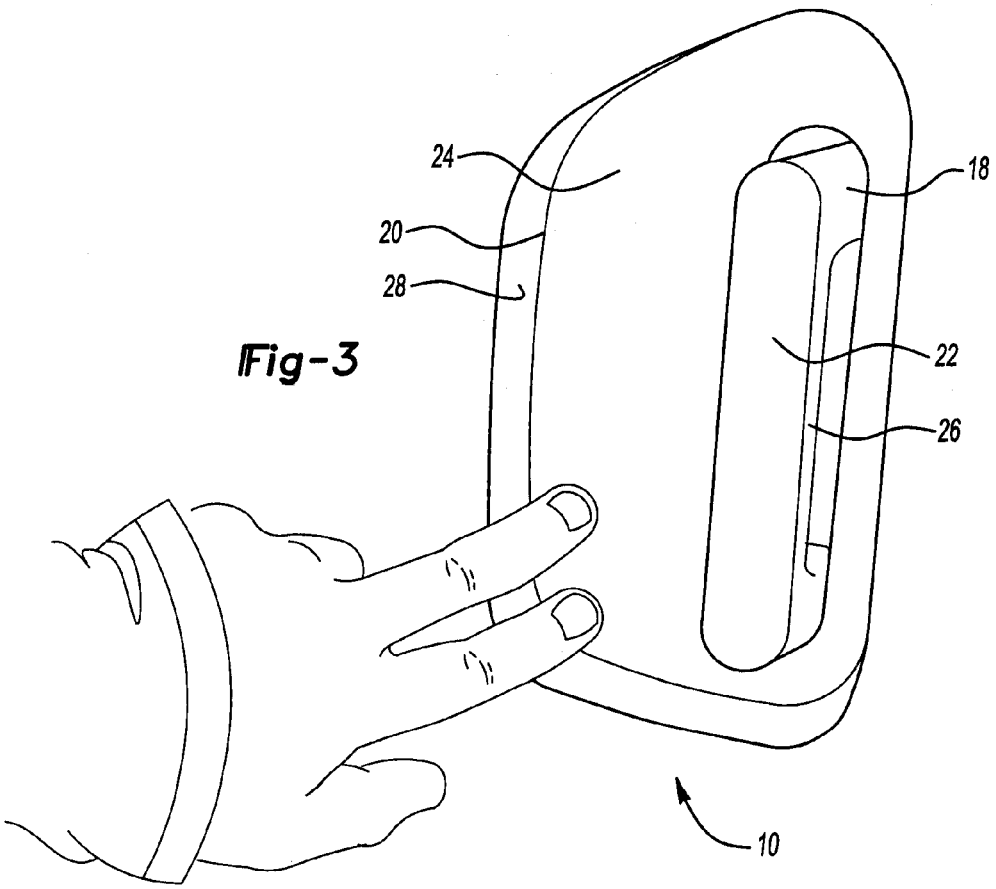
FIG. 3 is a perspective view of the door handle system of FIG. 1 and shows a user pressing in the body panel to reveal the grip portion.

FIG. 3 is a perspective view of system 10. Door handle 18 includes A-surface 22 (the finish surface of door handle 18), A-surface 24 (the finish surface of body panel 20), grip portion 26, and recess 28. A user is pressing in body panel 20 to reveal grip portion 26 of door handle 18. In doing so, A-surface 24 of body panel 20 is no longer flush with A-surface 22 of door handle 18.

Figure 4A:
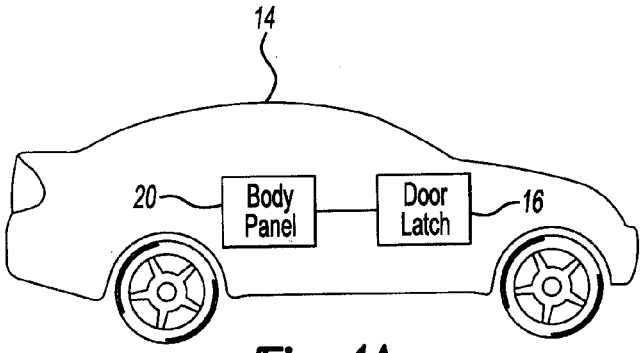
FIG. 4A is a block diagram of the mechanical relationship between a body panel and door latch in accordance with an embodiment of the invention.

FIG. 4A is a block diagram of an embodiment of the mechanical relation between body panel 20 and door latch 16. In this embodiment, body panel 20 is mechanically connected, in any conventional fashion, e.g., linked, with door latch 16 such that the pressing in of body panel 20 unlatches door latch 16 from vehicle 14. Once unlatched, a user may grasp handle 18 and pull open door 12.

Figure 4B:
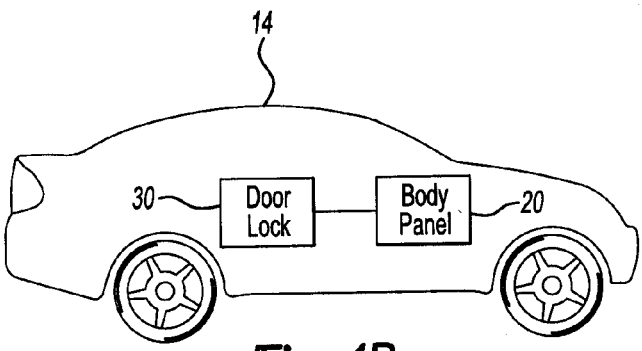
FIG. 4B is a block diagram of the mechanical relationship between a body panel and door lock in accordance with an embodiment of the invention.

FIG. 4B is a block diagram of an embodiment of the mechanical relation between body panel 20 and door lock 30. In this embodiment, body panel 20 is mechanically connected, in any conventional fashion, e.g., linked, with door lock 30 such that if door lock 30 is locked, body panel 20 will be flush with door handle 18 as shown in FIG. 2 and if door lock 30 is unlocked, body panel 20 will be spaced away from door handle 18 as shown in FIG. 3.

Figure 4C:
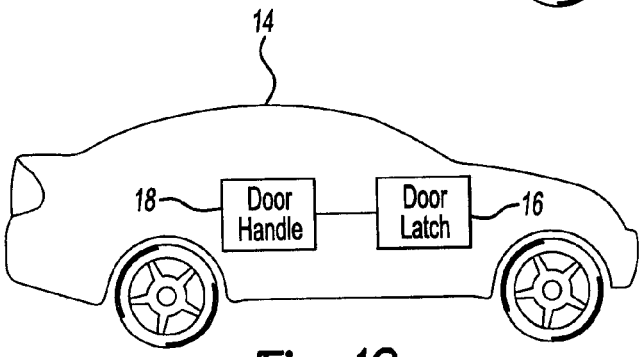
FIG. 4C is a block diagram of the mechanical relationship between a door handle and door latch in accordance with an embodiment of the invention.

FIG. 4C is a block diagram of an embodiment of the mechanical relation between door handle 18 and door latch 16. In this embodiment, door handle 18 is mechanically connected, in any conventional fashion, e.g., linked, with door latch 16 such that the actuation of door handle 18 will unlatch door latch 16 from vehicle 14.

Figure 4D:
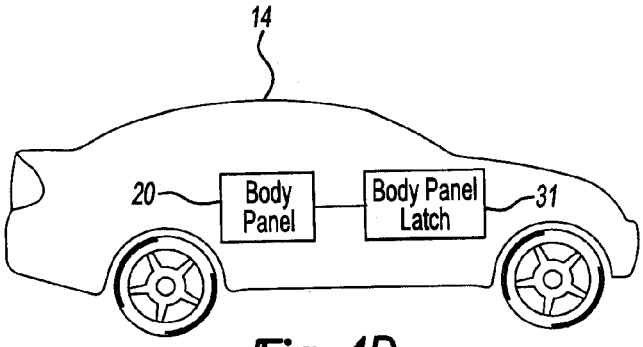
FIG. 4D is a block diagram of the mechanical relationship between a body panel and body panel latch in accordance with an embodiment of the invention.

FIG. 4D is a block diagram of an embodiment of the mechanical relation between body panel 20 and body panel latch 31 of system 10. Body panel latch 31 can be any conventional latching technology associated with a panel or door such that the pressing in of body panel 20 to a first predefined position latches body panel 20 in place until further pressing in to a second predefined position unlatches body panel 20 from vehicle 14 thus allowing body panel 20 to return back to its flush state with door handle 18.

The embodiments shown in FIGS. 4A-4D may be combined in any appropriate fashion. For example, the embodiments of FIGS. 4A and 4B may be combined such that door lock 30 is mechanically connected with body panel 20 and body panel 20 is mechanically connected with door latch 16. In this configuration, unlocking door lock 30 will unlatch door latch 16 from vehicle 14. The embodiments of FIGS. 4B and 4C may be combined such that door lock 30 is mechanically connected with body panel 20 and door handle 18 is mechanically connected with door latch 16. In this configuration, unlocking door lock 30 will move body panel 20 such that it reveals grip portion 26 of handle 18. A user may then actuate door handle 18 to unlatch door latch 16 from vehicle 14. Other configurations are also contemplated.

Figure 5:
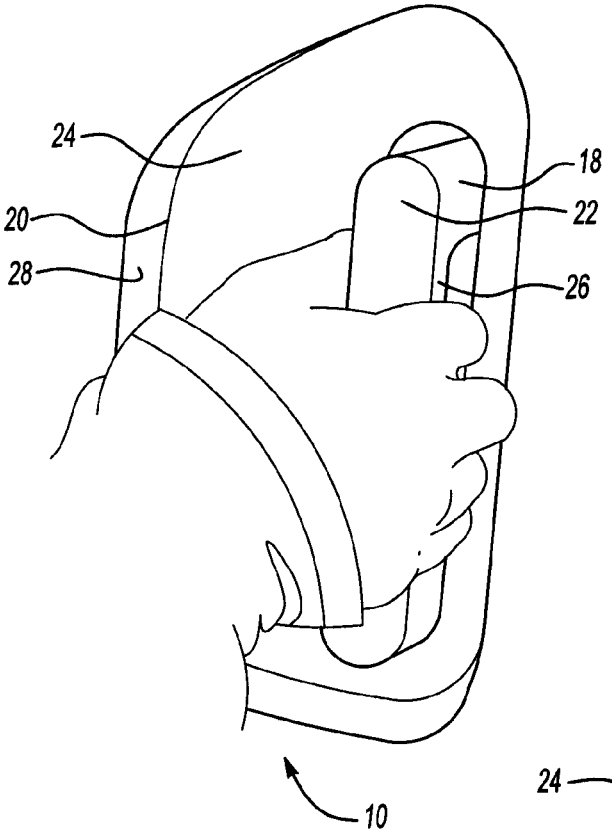
FIG. 5 is a perspective view of a door handle system in accordance with an embodiment of the invention and shows a user grabbing a door handle at a grip portion.

FIG. 5 is a perspective view of an embodiment of system 10 showing a user grabbing door handle 18 at grip portion 26. The user may then actuate door handle 18, if so configured, to unlatch door latch 16 from vehicle 14. Alternatively, the user may pull on door handle 18, if door latch 16 is already unlatched from vehicle 14, in order to open door 12.

Figure 6:
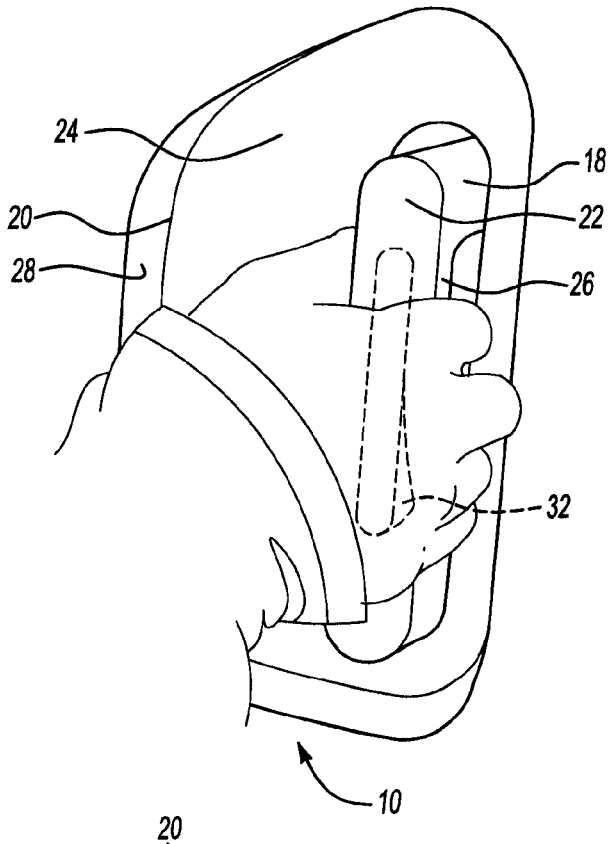
FIG. 6 is a perspective view of a door handle system in accordance with an embodiment of the invention and shows a user actuating a trigger of a door handle.

FIG. 6 is a perspective view of an alternative embodiment of system 10. In this embodiment, door handle 18 includes trigger 32, which is mechanically connected, in any conventional fashion, with door latch 16. By actuating trigger 32, door latch 16 is unlatched from vehicle 14.

Figure 7:
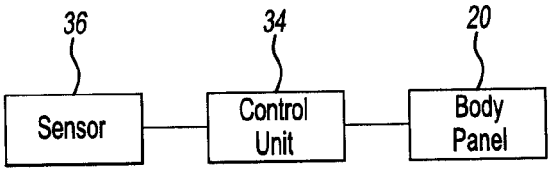
FIG. 7 is a block diagram of a control arrangement associated with a body panel in accordance with an embodiment of the invention.

FIG. 7 is a block diagram of a control arrangement associated with body panel 20. Control unit 34, e.g., processor and associated actuation mechanisms, is in communication with sensor 36 and body panel 20. As will be explained below, sensor 36 is configured to receive a signal, in any conventional fashion, that is then sent to control unit 34 which, based on the signal, actuates body panel 20 such that, for example, it moves from the flush position as shown in FIG. 2 to the pressed in position as shown in FIG. 3.

Figure 8:
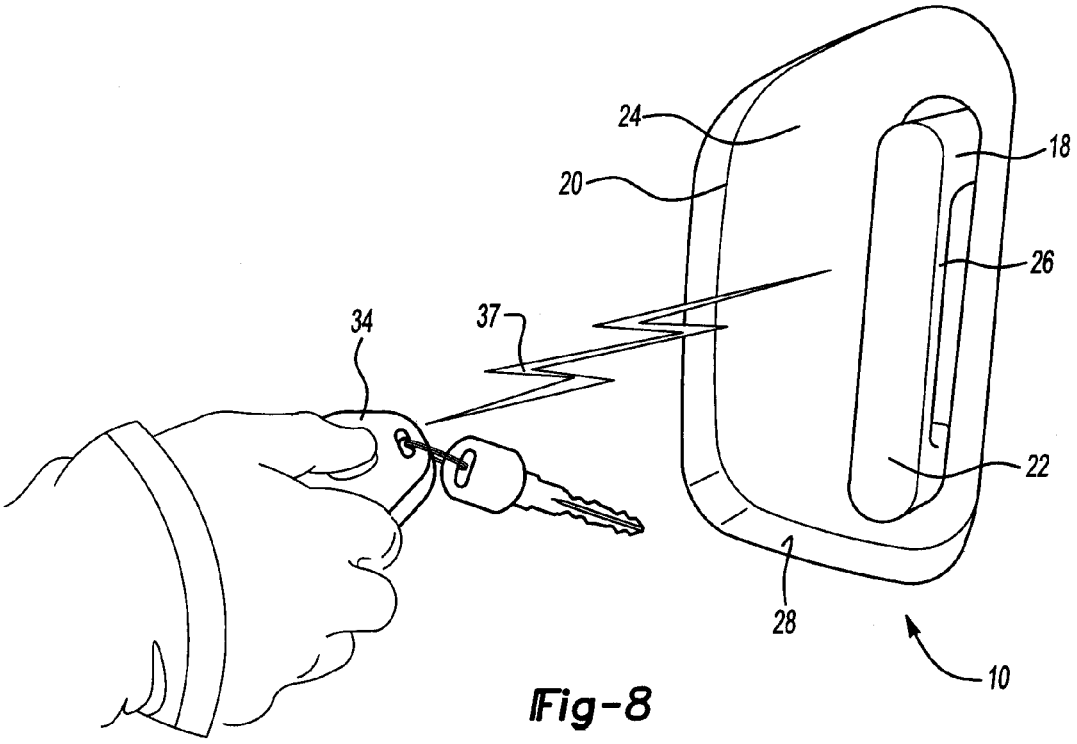
FIG. 8 is a perspective view of a door handle system in accordance with an embodiment of the invention and shows a signal from a key fob remotely actuating a body panel.

FIG. 8 is a perspective view of system 10 showing key fob 34 remotely actuating body panel 20 via signal 37.

Figure 9:
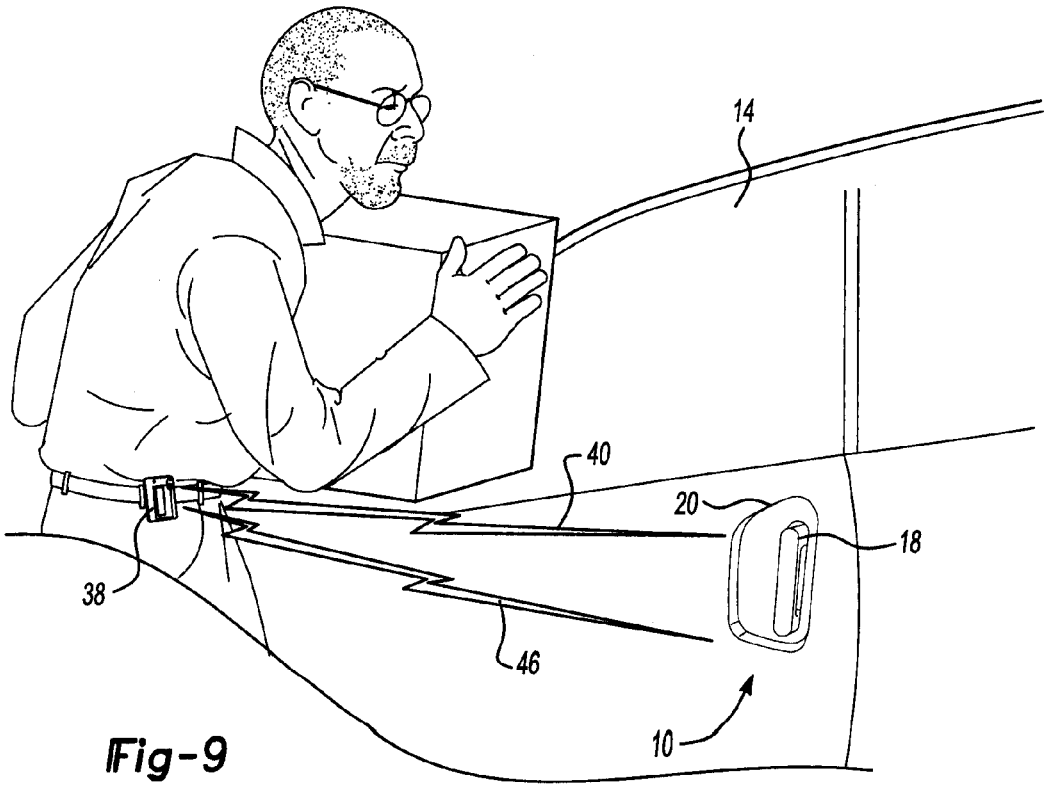
FIG. 9 is a perspective view of a door handle system in accordance with an embodiment of the invention and shows a signal from a proximity device remotely actuating a body panel.

FIG. 9 is a perspective view of system 10 showing proximity device 38 remotely actuating body panel 20 via signal 40. Proximity device 38 can be any conventional signal transmitting device, e.g., radio frequency transmitter.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A door handle system for a door of an automotive vehicle having an exterior, the system comprising:

a door operatively connected to the vehicle and moveable between an open and closed position, the door including a latching mechanism for latching the door to the vehicle if the door is in the closed position;

a door handle operatively connected to the latching mechanism such that actuation of the door handle unlatches the door from the vehicle if the door is latched to the vehicle, the door handle having a show surface that defines a portion of the exterior of the vehicle and including a finger receiving portion configured to receive a finger of a user; and a door panel adjacent the door handle, the door panel having an exterior surface and being linearly moveable between first and second positions without moving the door handle, the exterior surface of the door panel being substantially flush with the show surface of the door handle and defining a portion of the exterior of the vehicle if the door panel is in the first position, and the door panel concealing the finger receiving portion of the door handle if the door panel is in the first position.

2. The system of claim 1 wherein the door panel is spaced away from the show surface of the door handle such that it reveals the finger receiving portion of the door handle if the door panel is in the second position.

3. The system of claim 2 wherein a portion of the door and door panel define a recessed area around the door handle if the door panel is in the second position.

4. The system of claim 1 wherein the door panel is configured to be moved by a user from the first position to the second position.

5. The system of claim 1 further comprising a door panel latching mechanism for latching the door panel in the second position.

6. The system of claim 1 wherein the vehicle includes a sensor configured to receive a signal from a proximity device and wherein the door panel moves from the first position to the second position if the sensor senses the signal from the proximity device.

7. The system of claim 6 wherein the door panel moves from the second position to the first position if the sensor does not sense the signal from the proximity device.

* * * * *